United States Patent [19]

Bitzer et al.

[11] 4,374,006

[45] Feb. 15, 1983

[54] ELECTROLYTIC BATH FOR THE DEPOSITION OF HIGH GLOSS WHITE GOLD COATINGS

[75] Inventors: Eberhard Bitzer, Ebingen; Wilhelm Aichinger, Schwäbisch Gmünd; Gerhard Steinhilber, Aalen, all of Fed. Rep. of Germany

[73] Assignee: Degussa Aktiengesellschaft, Frankfurt, Fed. Rep. of Germany

[21] Appl. No.: 249,985

[22] Filed: Apr. 1, 1981 (Under 37 CFR 1.47)

[30] Foreign Application Priority Data

Apr. 3, 1980 [DE] Fed. Rep. of Germany ..... 3013030

[51] Int. Cl.[3] ..... C25D 3/62

[52] U.S. Cl. ..... 204/43 G

[58] Field of Search ..... 204/43 G, 46 G, 123

[56] References Cited

U.S. PATENT DOCUMENTS

| | | | |
|---|---|---|---|
| 3,475,292 | 10/1969 | Shoushanian | 204/44 |
| 3,883,409 | 5/1975 | Olivier | 204/44 |
| 3,981,782 | 9/1976 | Bradford et al. | 204/46 G |
| 4,012,294 | 3/1977 | Losi et al. | 204/43 G |

*Primary Examiner*—G. L. Kaplan

*Attorney, Agent, or Firm*—Cushman, Darby & Cushman

[57] ABSTRACT

Known white gold baths containing 2–10 g/l of gold as the sulfito complex, 2–40 g/l of alkali sulfite, 2–40 g/l of a complex former, 1–10 g/l of nickel and 1–20 g/l of cadmium, in each case in the form of a water soluble salt are sensitive to impurities of heavy metals and cyanide. This sensitivity is removed by adding 0.5–10 g/l of orotic acid and/or a derivative and/or salt thereof.

6 Claims, No Drawings

ELECTROLYTIC BATH FOR THE DEPOSITION OF HIGH GLOSS WHITE GOLD COATINGS

BACKGROUND OF THE INVENTION

The invention is directed to an electrolytic bath for the deposition of high gloss white gold coating having 2–10 g/l of gold in the form of a sulfide complex, 2–40 g/l of alkali sulfite, 2–40 g/l of a complex former, 1–10 g/l of nickel and 1–20 g/l of cadmium, in each case in the form of a water soluble salt.

For the corrosion resistant coating of commodities made of metal, as e.g. eyeglass frames, clockcases, bracelets or lighters there are frequently needed galvanic (electrolytic) coatings of white gold. There are known white gold baths which contain the gold as sulfite complex and besides contain alkali sulfite and ethylenediaminetetraacetic acid. As alloying metals there are customarily used copper, nickel and/or cadmium, as glossing agent, e.g. phosphonic acids (German OS No. 2334813 and related Olivier U.S. Pat. No. 3,883,409. The entire disclosure of Olivier and German OS No. 2042127 referred to therein are hereby incorporated by reference and relied upon). These baths permit the deposition of thick, ductile white gold coatings having a gold content of around 75%. However, it is a disadvantage that in the operation of such baths slight impurities of heavy metals such as lead or iron and cyanide ions or cyanide complex in many cases can lead to distrubances which unfavorably effect the gloss of the coating.

Therefore it was the problem of the present invention to provide an electrolytic bath for the deposition of high gloss white gold coatings having 2–10 g/l of gold in the form of a sulfite complex, 2–10 g/l of alkali sulfite, 2–40 g/l of a complex former, 1–10 g/l of nickel and 1–20 g/l of cadmium, in each case in the form of a water soluble salt, which is not sensitive to heavy metal and cyanide impurities.

SUMMARY OF THE INVENTION

This problem is solved according to the invention by including in the bath just described 0.5–10 g/l of orotic acid and/or its derivatives and/or salts. By orotic acid is meant uracil-4-carboxylic acid. Illustrative salts are the sodium and potassium salts.

Illustrative alkali sulfites are sodium sulfite and potassium sulfite.

Illustrative water soluble nickel and cadmium salts are nickel sulfate and cadmium sulfate.

Illustrative complex formers (complexing agents or chelating agents) include ethylenediamine, tetraethylenepentamine,triethylenetetramine, triethylamine, diethylenetriamine, nitrilotriacetic acid and its sodium and potassium salts, ethylenediaminetetraacetic acid and its sodium and potassium salts, 1,2-diaminocyclohexanetetraacetic acid and its sodium and potassium salts, bis-2-aminoethyletherteraacetic acid and its sodium and potassium salts, diethylenetriaminepentaacetic acid and its, sodium and potassium salts, 1-hydroxyethane-1,1-diphosphonic acid and its sodium and potassium salts, amonotrimethylenephosphonic acid and its sodium and potassium salts, ethylenediaminetetramethylphosphonic acid and its sodium and potassium salts, hexamethylene diamino tetra-(methyl phosphonic acid) and its sodium and potassium salts.

The baths of the invention are preferably operated at a pH between and 9 and 11 and at a temperature between 10° and 70° C., more preferably 50° to 70° C. and a current density between 0.5 and 2 A/dm$^2$.

The composition can comprise, consist essentially of or consist of the stated materials.

Unless otherwise indicated all parts and percentages are by weight.

The following example further explains the advantages of the baths of the invention.

DETAILED DESCRIPTION

There were dissolved in 1 liter of water 5 grams of gold in the form of its sulfito complex, 10 grams of disodium sulfite, 15 grams of tetra sodium ethylenediaminetetraacetate, 4 grams of nickel sulfate and 12 grams of cadmium sulfate. From this bath there was obtained at a pH of about 10 at 70° C. and a current density of 1 A/dm$^2$, a white, silk matte coating on an object placed in the bath, which coating contained about 80% gold and 20% cadmium besides traces of nickel. If there is added to these electrolytes 2 grams of 1-hydroxyethylidene 1,1-diphosphonic acid there is obtained indeed high gloss coatings, whose gloss, however, disappears again if there is added slight amounts of iron to the bath as impurity.

If there is added 6 grams of orotic acid to the electrolyte of 5 grams of gold as sulfito complex, 10 grams of disodium sulfite, 15 grams of tetrasodiumethylenediaminetetraacetate, 4 grams of nickel sulfate and 12 grams of cadmium sulfate, at a pH value of 10, at a temperature of 70° C. and a current density of 1 A/dm$^2$ there is likewise obtained high gloss, white layers on an object placed in the bath which layers grow up to a coating thickness of over 30$\mu$ absolutely free from cracks and have an excellent gloss. These baths are substantially non-sensitive to impurities caused by heavy metals and especially cyanide. There are obtained with these baths gold coatings having 66 to 75% gold, balance cadmium, according to the current density whereby higher current densities cause a higher cadmium content in the coating.

The entire disclosure of German priority application No. P 3013030.4 is hereby incorporated by reference.

What is claimed is:

1. An electrolytic bath for the deposition of high gloss white gold coating comprising 2–10 g/l of gold in the form of a sulfite complex, 2–40 g/l of alkali sulfite, 2–40 g/l of a complexing agent, 1–10 g/l of nickel and 1–20 g/l of cadmium in each case in the form of a water soluble slat and 0.5–10 g/l of orotic acid, a derivative of orotic acid or a salt of orotic acid.

2. An electrolytic bath according to claim 1 including orotic acid or a slat thereof.

3. An electrolytic bath according to claim 2 including tetrasodium ethylenedeaminitetraacetate and 1-hydroxyethylidene-1,1-diphosphonic acid as complexing agents.

4. A bath according to claim 2 having a pH between 9 and 11.

5. A method of depositing a high gloss white gold coating on an object comprising placing the object in the bath of claim 2 at a temperature between 10° and 70° C. and applying a current density of 0.5 to 2 A/dm$^2$.

6. A method according to claim 5 wherein the temperature is 50° to 70° C.

* * * * *